United States Patent [19]

Boxer

[11] Patent Number: 4,753,252

[45] Date of Patent: Jun. 28, 1988

[54] HAIR CLIP

[76] Inventor: Leonka R. Boxer, 192 Collins St., Apt. A, San Francisco, Calif. 94118

[21] Appl. No.: 942,190

[22] Filed: Dec. 16, 1986

[51] Int. Cl.[4] ..... A45D 8/24

[52] U.S. Cl. ..... 132/48 R

[58] Field of Search ..... 132/48 R, 48 A, 46 A, 132/46 R, 47; 24/3 L, 49 CC, 564, 327

[56] References Cited

U.S. PATENT DOCUMENTS

| | | | |
|---|---|---|---|
| 1,241,960 | 10/1917 | Gould | 132/48 R |
| 1,516,661 | 11/1924 | Bechtold | 132/48 R |
| 1,654,560 | 1/1928 | Sterling | 132/48 R |
| 2,111,328 | 3/1938 | Polak | 132/48 R |
| 2,361,772 | 10/1944 | Kaplan | 132/48 R |
| 3,412,739 | 11/1968 | Thatcher | 132/48 R |

FOREIGN PATENT DOCUMENTS

| | | | |
|---|---|---|---|
| 10952 | 11/1909 | France | 132/48 R |

*Primary Examiner*—Robert P. Swiatek
*Assistant Examiner*—Cary E. Stone

[57] ABSTRACT

A hair clip (20) capable of holding items of decoration or the like. The hair clip consists of a plate-like base (32) having an omega-shaped cross-sectional configuration. At its one end the base is hingedly connected to a locking device (34), while at the end opposite to the above-mentioned hinge the base has a slot formed between hook-like elements (100*a*) and (100*b*). The base is provided with projections or teeth (42*a*) and (42*b*) which in a locked position of the clip engage slots or gaps located on the locking element. The above-mentioned omega-shaped cross-sectional configuration is used as a guide for the insertion of a holder (70) which may carry various items of decoration such as flowers.

15 Claims, 2 Drawing Sheets

FIG. 8
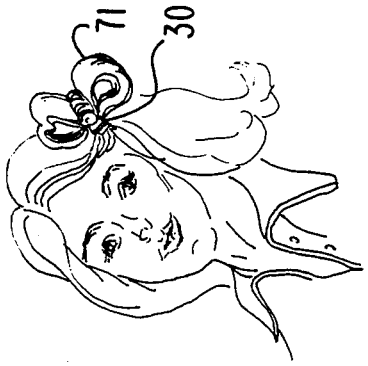
FIG. 7
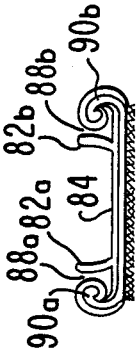
FIG. 6
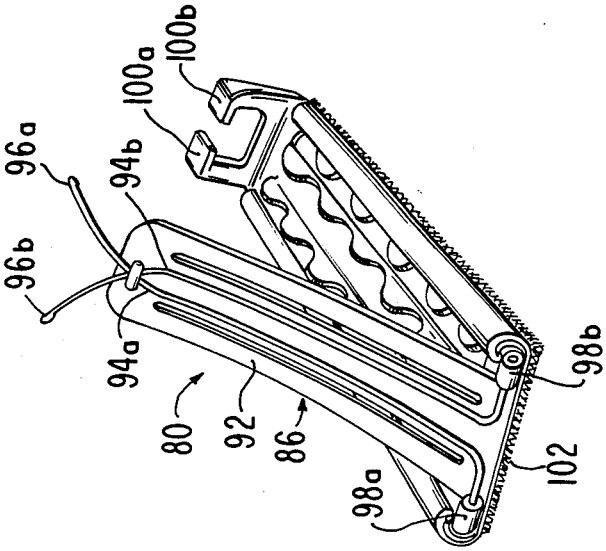
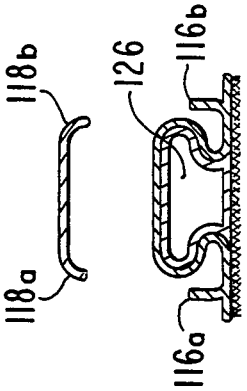
FIG. 10
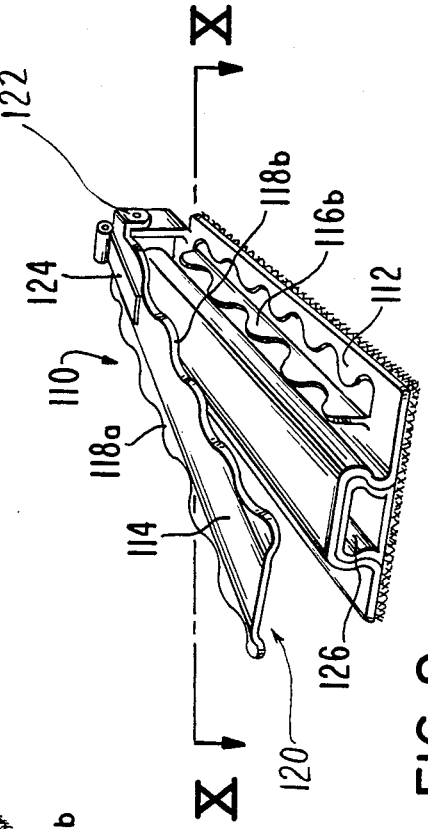
FIG. 9

HAIR CLIP

BACKGROUND

1. Field of the Invention

The invention relates to a hair clip, particularly to a hair clip capable of holding items of decoration or the like.

2. Description of the Problems and Prior Art

A great variety of hair clips are known. One such hair clip was manufactured in Japan in 1966 by Leonka Designs Corp. in Osaka. A perspective view of this hair clip is shown in FIG. 1. The hair clip, which is designated generally by reference numeral 20, is rather simple in its construction. It consists of a plate-like base 22 having a hinge 24 on one end. The hinge serves for pivotal attachment of a U-shaped lock element 26 with springing legs 26*a* and 26*b*. Another end of base 22 has inwardly bent lugs 28*a* and 28*b* which hold corresponding legs 26*a* and 26*b* in a locked position. Base 22 has shallow grooves 27*a* and 27*b* which receive corresponding legs 26*a* and 26*b* in their locked position. In use, the portion of hair, which has to be fixed with hair clip 20, is placed onto the surface of base 22 and is fixed by squeezing legs 26*a* and 26*b*, turning them inward on hinge 24, inserting them into a space between lugs 28*a* and 28*b*, and then releasing the legs into the lugs. Under the effect of a springing force, legs 26*a* and 26*b* move apart and are locked beneath the lugs.

Although the above-described hair clip is simple in construction, it has a number of disadvantages which are the following:

Grooves 27*a* and 27*b* are shallow and cannot protect the hair clip against sliding on hair which is clamped between base 22 and legs 26*a* and 26*b*. Clamping is very awkward and inconvenient because lugs 28*a* and 28*b* are located within the outlines of the clip, and the gap between lugs 28*a* and 28*b* cannot be easily located by touch. Furthermore, the clip of this design cannot be used for attachment of alternative items of decoration to hair.

OBJECT AND ADVANTAGES OF THE PRESENT INVENTION

Accordingly, it is an object of the present invention to provide an improved hair clip which can be firmly fixed on hair, is convenient in use and can hold items of decoration. Other advantages and features of the hair clip of the invention will become apparent from a consideration of the ensuing description and drawings.

BRIEF DESCRIPTION OF DRAWINGS

FIG. 6 is a perspective view of a hair clip made in accordance with another embodiment of the invention.

FIG. 7 is a sectional view of the hair clip of FIG. 6.

FIG. 8 is a perspective view illustrating the hair clip placed on the hair with decoration attached to the clip.

FIG. 9 is an embodiment of the clamping device with two sets of engaging teeth.

FIG. 10 is a sectional view along lines X—X of FIG. 9.

REFERENCE NUMERALS USED IN THE DRAWINGS AND DESCRIPTION

30—hair clip
32—base
34—locking device
36*a*, 36*b*—pivotal connection
38*a*, 38*b*—hinges
40*a*, 40*b*—pin-like ends
41*a*, 41*b*—grooves of the omega-shaped configuration
42*a*, 42*b*—*projections*
44*a*, 44*b*—shoulders
46*a*, 46*b*, 48*a*, 48*b*—rod-like elements
50—fulcrum point
52—spring
54*a*, 54*b*—outer legs
70—holder
71—item of decoration
72—holding element
80—hair clip
82*a*, 82*b*—inner surface
84—base
86—locking device
88*a*, 88*b*—deep grooves
90*a*, 90*b*—bent edges of the base
92—plate
94*a*, 94*b*—rods
96*a*, 96*b*—outer legs
98*a*, 98*b*—pivotal attachment
100*a*, 100*b*—hook-like elements
102—Velcro-type holding elements
110—hair clip
112—base
114—locking mechanism
116*a*, 116*b*, 118*a*, 118*b*—projections
120—locking element
122—hinge
124—spring
126—guide slot for the holder
H—hair
G1, G2—gaps

FIGS. 2-5—PREFERRED EMBODIMENT OF THE INVENTION

Figure 2:
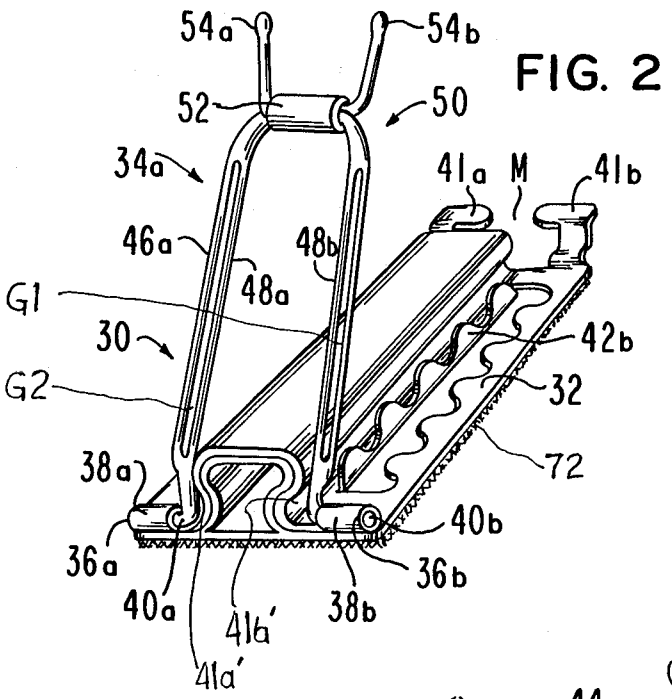
FIG. 2 is a perspective view of a hair clip of the invention in an open or unlocked position.

A hair clip in accordance with one embodiment of the invention is shown in FIG. 2, which is a perspective view of a hair clip in its open and upside down position, i.e. in the working or locked position the upper surface of the clip shown in FIG. 2 will face away from the scalp of the wearer.

Figure 1:
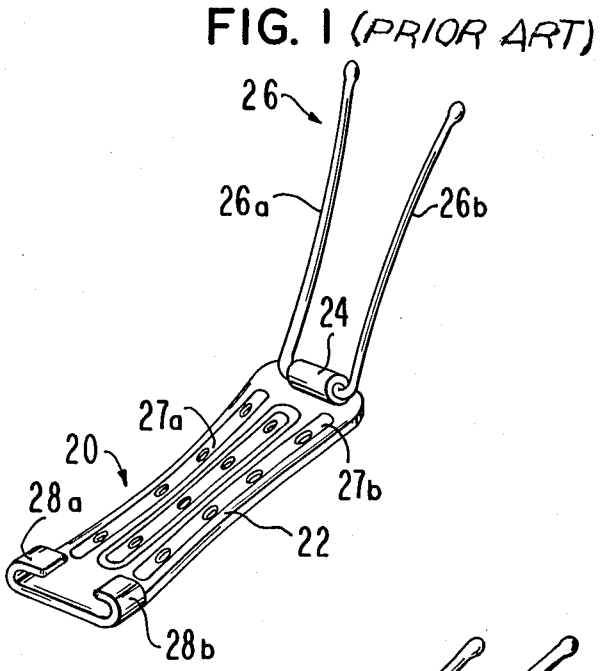
FIG. 1 (PRIOR ART)
FIG. 1 is a perspective view of a prior-art hair clip.

As shown in FIG. 1, the hair clip, which is generally designated with reference numeral 30, consists of a plate-like base 32 and a locking device 34 which is pivotally connected to plate-like base 32 at a pivotal connection 36*a*, 36*b*. As shown in FIG. 2, this pivotal connection may be formed by two hinge-like elements 38*a* and 38*b* attached to base 32, and pin-like ends 40*a* and 40*b* of locking device 34, inserted into respective hinge-like elements 38*a* and 38*b*.

On the opposite side of the hinges, the base has a head formed by two symmetrical hook-like elements 41*a* and 41*b* with a space or mouth M formed between the facing ends of the hook.

Figure 4:
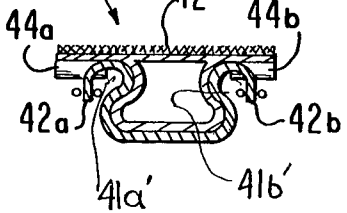
FIG. 4 is a cross-sectional view along line IV—IV of FIG. 3.
Figure 3:
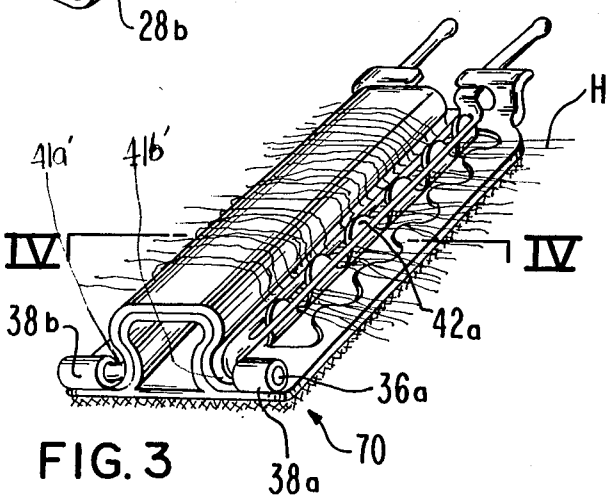
FIG. 3 is a perspective view of a hair clip of FIG. 2 in a locked position on the hair (for convenience of illustration of the hair clip's details, it is shown in a turned-over position; in a locked position the upper surface of the hair clip of FIG. 3 faces the scalp of the wearer).

In its cross-section, plate-like base 32 has an omega-shaped configuration with grooves 41*a* and 41*b* (see FIGS. 3 and 4). While wearing the hair clip, the closed part of the omega-shaped configuration faces away from the scalp of the wearer. Projections 42*a* and 42*b* are extending radially outwardly beneath the shoulders of the omega-shaped configuration starting at the apexes of angles formed between the shoulders 44*a* and 44*b* of the omega-shaped configuration and its side elements (see FIG. 4). These projections can be formed by stamping from the material of the plate, if the clip is made of metal, or they can be formed by molding, if the clip is made of plastic.

As shown in FIG. 4, in their longitudinal direction, projections 42*a* and 42*b* are bent down and then flattened. This is necessary to keep the tips of the projections from digging into the scalp.

Figure 5:
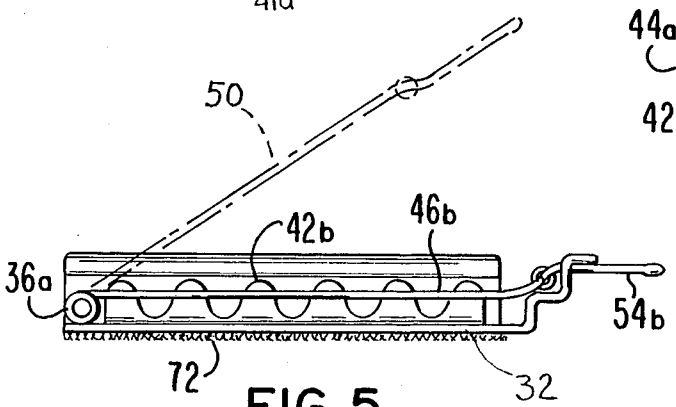
FIG. 5 is a side view of the hair clip in its locked position.

As shown in FIG. 5, which is a side view of the hair clip of FIG. 2, the head of base-like plate 32 is bent downward facing the scalp of the wearer. In FIG. 5 the hair clip is shown as straight, but it is understood that when the clip has a substantial length, it can be bent in a longitudinal cross section in order to accommodate the curvature of the head.

In the embodiment of FIGS. 2–5, locking element 34 is formed of two pairs of rod-like elements 46*a*, 46*b* and 48*a*, 48*b*. These pairs of elements are connected in a scissor-like fashion with a fulcrum point 50 having a spring 52 which always tends to spread outer legs 54*a* and 54*b* apart. The ends of the rods opposite to legs 54*a* and 54*b* are exactly the same as the pin-like ends (40*a*, 40*b*) which provide the pivotal connection between locking device 34 and plate-like base 32.

As has been mentioned above, each leg of the scissor like element of the clamping mechanism is formed by a pair of rods. As shown in FIG. 2, the rods of each pair are assembled so that grooves G1 and G2 are formed between the rods on each side of the clamping mechanism. As shown in FIG. 3, and as will be explained later in description of operation of the clip, these grooves will accommodate projections 42*a* and 42*b*, respectively.

The hair clip of the invention has a holder which is attached to the clip and is generally designated by reference numeral 70. The above-mentioned omega-shaped configuration formed in the body of plate-like base 32 serves as a guide for insertion and attachment of holder 70. To this end, the holder has a cross-section conforming to the above-mentioned omega-shaped configuration. This configuration is clearly shown in FIG. 4 which is a cross-section of the clip along line IV—IV on FIG. 3. Although in this drawing the holder is shown also with an omega-shaped configuration, it is understood that it may have any other suitable shape. For example, it may have a rail-like cross section shown in FIG. 4. The holder can be made of any suitable material. It can be molded of plastic, can be formed of wire, can be made of metal casting, etc.

The outer side of holder may be provided with a holding element 72. In the illustrated embodiment this holding element is formed of multiple, tiny hooks capable of attachment to the surface of the mating object sold under the trademarks Velcro or Latchlock. The Velcro element can be connected to holder 70 by means of adhesive, or by fasteners, etc. It is understood that Velcro is shown as an example only and any other holding elements can be attached to the outer side of the holder.

FIGS. 2–5—OPERATION OF THE HAIR CLIP

In order to clip to hair, the user holds the hair clip by base 32 with one hand and put the hair clip into position at which point rod-like elements 46*a* and 46*b* with corresponding outer legs 54*b* and 54*a* slide into the hair. With the other hand the user then finds the outer legs 54*a* and 54*b* and squeezes them together to the extent that they may pass through the mouth M between two symmetrical hook-like elements 41*a* and 41*b*. For locking the hair clip, locking device 34, with the outer legs being squeezed, is turned downward on pivots 36*a* and 36*b*. With the downward action of the locking device, projections 42*a* and 42*b* penetrate into the slots formed between rod-like elements 46*a*, 48*a* and 46*b*, 48*b*. When these rod-like elements reach grooves 41*a* and 41*b* of the omega-shaped configuration, the outer legs are released so that under the effect of their resiliency, they spread apart and lock the clip. Locking device 34 is fixed by a downwardly directed springing force of the rod-like elements so that they are positively held in the above-mentioned grooves. The portion of hair, which was between locking device 34 and base 32 is locked fast by the hair of the clip. In other words, the entire clip is held tightly to the hair.

Now the hair clip assumes the position shown in FIG. 3, where for the sake of clarity it is shown in an upside down position with hair designated by H.

In the clamped position of the hair clip, the hair is pressed into deep grooves 41*a* and 41*b* of the omega-shaped configuration, and is held fast between base 32 and locking locking device 34.

Apart from the hair-clipping function, the hair clip 30 can be used also for holding various items that attached to hair or garments, such as flowers, beads, toys, etc. To this end, holder 70 is used. As shown in FIG. 8, a bow 71 is attached to the hair by means of hair clip 30 of the invention. As has been mentioned above, on its other side the holder has a holding surface, which in the case of the illustrated embodiment, comprises Velcro capable of holding the above-mentioned items.

It is understood, however, that the Velcro, as well as the decoration of FIG. 8 are shown only by way of example and that any other suitable holding means and a great variety of other decorations or items can be used. In a similar manner, the hair clip can be attached not only to hair but also to garments, etc. Therefore the illustrated examples should not be construed as limitative.

FIGS. 6–9—OTHER EMBODIMENTS OF THE INVENTION

FIG. 6 is a perspective view of another embodiment of the invention. In FIG. 6 the hair clip is designated generally by reference numeral 80. In principle, it is the same as hair clip 30 of FIGS. 2 and 3 but differs in that it is concave in its cross-section, as is shown in FIG. 7, i.e. it is curved in longitudinal and transverse directions in order to conform with the curvature of the head of the wearer. This simplifies the structure, makes the clip more simple to manufacture and, what is most important, increases the holding power of the clip because of a larger surface of contact between a base 84 and a locking device 86.

In the case of embodiment shown in FIGS. 6 and 7, the deep grooves which have been mentioned above and which constitute a distinguishing feature of the present invention are formed between the inner surfaces of upwardly bent edges 90*a* and 90*b* of base 84 and the inner surfaces of projections 82*a* and 82*b*.

In this embodiment, locking element 86 also differs in that it consists of a plate 92, which also has a concave cross-sectional configuration to conform with the shape of the base, and resilient rods 94*a* and 94*b*. These rods have the same purpose as rods 46 and 48 in the previous embodiment of the invention and likewise are provided with outer legs 96*a* and 96*b*. Rods 94*a* and 94*b* are pivotally attached to the base at 98*a* and 98*b*. Similar to the previous case, the base has a mouth M1 formed between two symmetrical hook-like elements 100*a* and 100*b*.

Hair clip 80 has a Velcro-type holding element 102 attached tp the external surface of the base. The Velcro element, or the like, can be attached to base 84 by adhesive, but it also can be constructed to be removable. For this purpose, the edges of the base can be bent as shown in FIG. 7. so that the bent portions can be used as tracks for holding pins (not shown) to attach the clip to a garments or to other objects.

Hair clip 80 is locked and used in the same manner as one described in connection with the embodiment of FIGS. 2–5. Therefore the description of its operation, as well as the attachment of various items, are omitted.

Another embodiment of the invention is shown in FIG. 9 in the form of a hair clip 110. This hair clip has a base 112 of the same omega-shaped cross section as base 32 in hair clip 30 of FIG. 2. It differs, however, by the design of its locking mechanism 114, which consists of projections 116*a* and 116*b* formed on the base, and mating projections 118*a* and 118*b* on a locking element 120, which, by means of a hinge 122, is pivotally attached to base 112. Locking mechanism can be formed as a plate with outward projections 118*a* and 118*b* on its side edges. It is understood, however, that it can be made in the form of a frame or in any other shape, provided it has projections 118*a* and 118*b* engageable with projections 116*a* and 116*b* on the base.

Locking mechanism 114 is normally in a closed state under the effect of a leaf spring 124 which constantly urges locking element 120 downward to the base. It is understood that leaf spring 124 can be substituted by a coil spring or by spring forced developed in the locking element itself.

FIG. 10 is a sectional view along line X—X of FIG. 9. As shown, projections 118*a* and 118*b* are bent so that in a closed state (not shown) of the locking mechanism they will not touch the head of the wearer.

The same holder (70) as in the case of hair clip of FIG. 2 can be inserted into the omega-shaped guide slot (126) formed in base 112.

For attachment to hair or any other object, locking element 120 is lifted against the force of closing spring 124, the hair, cloth, etc., is inserted between locking element 120 and base 112, and the locking element is then released. In a released state, under the effect of the force developed by spring 124, the clip is locked, and projections 118*a* and 118*b* of the locking element come into spaces between projections 116*a* and 116*b*. As a result, the hair or another appropriate object to which the clip is attached appears to be positively fixed between the locking mechanism and the base of the clip.

It is obvious to those skilled in the art that the invention is not limited only to the examples shown above and that many other forms and modifications are possible without departure from the scope of the invention convered by the claims given below. For example, the whole clip can be molded from plastic or can be made of metal, or its base can be made of plastic and can be assembled with a metal locking mechnaism. The omega-shaped configuration of the guide slot also was shown as an example and other cross-sectional configurations (such as T-shape, etc.) are possible, that provided the outer surface of the guide portion forms deep grooves in cooperation with projections, and that the inner shape of the guide slot keeps the holder locked in the guide slot. The holder can be made in the form of a U-shaped corrugated wire element with corrugations being engageable with the above-described projections. It is also understood that a great variety of decoration can be attached to the holder and that, apart from clipping to the hair, the device with its various items can be used for clipping to other objects, i.e., it can be used as a flowered broach or the like. Apart from Velcro, the outer surface of the holder may have holes for sawing onto a garment or any accessory such as a hat purse, etc. The inner surface of the hair clip can have a track with a safety pin for attachment to a hat, scarf, etc.

Thus the scope of the invention should be determined by the appended claims and their legal equivalents, and not by the examples given.

I claim:

1. A hair clip asembly comprising:

a hair clip comprising a base element and a locking element, said base element having first engaging means and first locking means;

said locking element pivotally connected to said base element at a position on said base element remote from said first locking means, said locking element having second engaging means, which interacts with said first engaging means, and second locking means engageable with said first locking means for holding said locking element in a locked position, said base element having a cross-sectional configuration with an inner side and an outer side, said cross-sectional configuration, in cooperation with said first engaging means, forming grooves on said outer side of said cross-sectional configuration and a guide slot on said inner side of said cross-sectional configuration; and holding means for holding various items, said holding means being insertable into said guide slot on said inner side of said cross-sectional configuration and being positively locked in said guide slot for attachment of said holding means to said hair clip.

2. A hair clip according to claim 1, wherein said cross-sectional configuration is substantially omega-shaped.

3. A hair clip according to claim 1, wherein said locking element is formed of two pairs of parallel rods with a gap between said rods, said first engaging means comprising projections which extend radially upwardly from the bottom of said grooves, whereas said second engaging means comprises said gap between said rods.

4. A hair clip according to claim 1, wherein said first locking means is formed of two symmetrical hook-like elements on the end of the base distal from said pivotal connection, said hook-like elements having a pair of respective facing ends which form a slot between said facing ends, said second locking means comprising a pair of squeezeable outward extensions of said locking element, said extensions being located at the end of said locking element remote from said pivotal connection, said outward extensions being spring-loaded so that they are constantly spread apart, the thickness of said outward extensions in a squeezed position being smaller than said slot so that said outward extensions can be inserted through said slot into a space between said hook-like elements.

5. A hair clip according to claim 1 wherein said first engaging means comprises first projections which extend radially outwardly from the bottom of said grooves, said locking element comprises a plate with side edges, and said second engaging means has a plurality of second projections formed on said side edges of said plate and extending outwardly and downwardly from said plate towards said first projections so that in a closed state of the hair clip, said second projections are fixed in spaces between said first projections; and further including spring means which constantly urge said locking element to said base element.

6. A hair clip according to claim 5, wherein said second projections have tips which are bent in a direction parallel to the plane of said plate in order to prevent their contact with the scalp of the wearer.

7. A hair clip according to claim 1, wherein said holding means provided with means for holding various items.

8. A hair clip according to claim 7, wherein said means for holding has an outer surface with multiple tiny hooks capable of holding an engaging object pressed to said hooks.

9. A hair clip comprising: a plate-like base element having an omega-shaped cross-sectional configuration with outer and inner sides and with side grooves formed on said outer side of said omega-shaped configuration, said side grooves having bottoms, a plurality of respective projections extending radially outwardly from said bottoms of said grooves, said plate-like base having an end in the form of two symmetrical hook-like elements with respective facing ends, said facing ends forming a slot between said facing ends, a locking device which is pivotally attached to said plate-like base at its end remote from said hook-like elements, said locking device comprising a pair of spaced rods which are parallel to each other and are connected in a scissors-like manner so that gaps are formed between said rods on a portion of said scissors between said pivotal connection and a fulcrum of said scissors, the outer ends of said rods being spread apart by a springing force of said rods, the thickness of said rods being such that when said outer ends are squeezed, their thickness is smaller than said slot between the hook-like elements so that said outer ends can pass through said slot into a space defined by hook-like elements; and a holder having substantially an omega-shaped cross-sectional configuration for insertion into said inner guide slot of said omega-shaped portion of said base.

10. A hair clip according to claim 9, wherein said base is molded of plastic.

11. A hair clip according to claim 9, wherein said rods are made of metal.

12. A hair clip according to claim 9, wherein said holder has article holding means on its outer surface.

13. A hair clip according to claim 12, wherein said holder has an outer surface with multiple tiny hooks capable of holding an engaging object pressed to said hooks.

14. A hair clip comprising: a plate-like base with inwardly bent and curved edges on the sides of said plate; first engaging means on said base; first locking means on said base; a plate-like locking element pivotally connected to said base at an end remote from said first locking means; second engaging means on said locking element for engagement with said first engaging means; second locking means on said locking element at its end opposite to said pivotal connection, said second locking means being capable of locking said hair clip on an object to which the hair clip is attached when said second locking means interacts with said first locking means; spring means constantly urging said locking element toward said base; and holding means on the outer side of said hair clip opposite to said locking element, said holding means having edges bent upwardly and curved inwardly in the same manner as said edges of said base, but with a larger radius of curvature so that the curved edges of said base serve as guides for attachment of said holding means to said base when the edges of the base are inserted into the space defined by said curved edges of said holder.

15. A hair clip according to claim 14 wherein said first engagine means comprises projections extending outwardly and at an angle less than 90° from the plane of said plate-like base, said first locking means comprising two symmetrical hook-like elements on said base with respective facing ends and a slot between said facing ends, said base being curved in a longitudinal direction as well as in a tranverse direction to accommodate the curvature on the head of a wearer, said second locking element comprising a plate which is curved in a longitudinal direction and in a transverse direction similar to said base and has two longitudinal slots, each of which is engageable with said projections when the hair clip is closed; said spring means comprising two spring-loaded rods which are connected in a scissors-like manner to each other at a point on said locking element and are pivotally connected to said base at the end opposite to said second locking means; said second locking means being formed by outer ends of said rods, said rods being squeezable and insertable into said slot between said hook-like elements.

* * * * *